US005483804A

United States Patent [19]

Ogawa et al.

[11] Patent Number: 5,483,804

[45] Date of Patent: Jan. 16, 1996

[54] DEFROST CONTROL APPARATUS FOR REFRIGERATOR

[75] Inventors: Atsushi Ogawa, Kyoto; Yoshio Ozawa, Hirakata; Toshimichi Hirata, Gunma; Tsuyoshi Kawai, Uji; Kiyoshi Fukushima, Kobe; Masashi Toyoshima, Gunma, all of Japan

[73] Assignee: Sanyo Electric Co., Ltd., Moriguchi, Japan

[21] Appl. No.: 218,598

[22] Filed: Mar. 28, 1994

[51] Int. Cl.[6] ..... F25D 21/06

[52] U.S. Cl. ..... 62/153; 62/155; 62/234

[58] Field of Search ..... 62/80, 131, 151, 62/153, 155, 234

[56] References Cited

U.S. PATENT DOCUMENTS 5,315,835 5/1994 Park ..... 62/153 X 5,372,015 12/1994 Suzuki et al. ..... 62/228.4

*Primary Examiner*—Harry B. Tanner

*Attorney, Agent, or Firm*—Hoffmann & Baron

[57] ABSTRACT

A defrost control apparatus for refrigerator includes a microcomputer which counts the number of opening/closing times of a door of a storage room for each of time zones within a day so as to set indexes for every time zones on the basis of the number of opening/closing times. The microcomputer also counts operating hours of a compressor and total elapsed hours, and determines a sudden phenomenon and a season. The microcomputer further selectively fetches the indexes, and generates a single index by joining a plurality of indexes so as to apply the same to a neural network included in a defrost signal generating unit. The neural network generates a defrost on/off signal on the basis of inputted data. In addition, if feature amounts are generated on the basis of the indexes by a feature detecting unit, the neural network generates the defrost on/off signal on the basis of the feature amounts.

18 Claims, 8 Drawing Sheets

DEFROST CONTROL APPARATUS FOR REFRIGERATOR

BACKGROUND OF THE INVENTION

1. Field of the Invention

The present invention relates to a defrost control apparatus for refrigerator. More specifically, the defroster which defrosts a condenser by supplying a high-temperature refrigerant by means of switching of a refrigerant flow switching valve in a refrigeration cycle or by heating an electric heater.

2. Description of the Prior Art

A conventional defrost control apparatus for refrigerator is disclosed in, for example, Japanese Utility Model Publication No. 55-7795 published on Feb. 21, 1980. In the prior art, operating hours of a refrigeration cycle is integrated by a timer, and a defrost operation is started at every time point that the integrated hours reaches a predetermined time.

However, in such a prior art, since the defrost operation is started at arbitrary time points by the timer, there was a problem that a temperature of a storage room is increased because it is impossible to refrigerate the storage room when the defrost operation is performed. That is, in a case where the defrost operation is started in a time zone wherein a frequency of opening/closing of the door of the storage room is large, in spite of a state where the storage room cannot be refrigerated, the outside air frequently enters in the storage room.

SUMMARY OF THE INVENTION

Therefore, a principal object of the present invention is to provide a novel defrost control apparatus for refrigerator.

Another object of the present invention is to provide a defrost control apparatus in which it is possible to suppress a temperature of a storage room from being increased at a time of a defrost operation.

Another object of the present invention is to provide a defrost control apparatus in which it is possible to suppress, with simple structure, an increase of a temperature of a storage room at a time of a defrost operation.

Another object of the present invention is to provide a defrost control apparatus in which it is possible to suppress, with a simple process, a temperature of a storage room at a time of a defrost operation.

Another object of the present invention is to provide a defrost control apparatus in which it is possible to control a defrost operation by utilizing the number of opening/closing times of a door of a storage room for each of respective time zones within a day.

Another object of the present invention is to provide a defrost control apparatus in which it is possible to control a defrost operation by taking whether or not the number of opening/closing times of the door is dependent on a sudden phenomenon into consideration.

Another object of the present invention is to provide a defrost control apparatus in which it is possible to control a defrost operation by taking the number of opening/closing times of the door in a few time zones.

Another object of the present invention is to provide a defrost control apparatus in which it is possible to control a defrost operation by taking a season into consideration.

Another object of the present invention is to provide a defrost control apparatus in which it is possible to control a defrost operation by utilizing a neural network.

In a defrost control apparatus for refrigerator according to the present invention, the number of opening/closing times of a door of a storage room is counted by counting means for each of respective time zones within a day, and the number of opening/closing times is stored in an opening/closing times memory. On the basis of the number of opening/closing times for each of the respective time zones, indexes of the respective time zones are set by index setting means. In accordance with the indexes, a defrost on/off signal is generated by defrost signal generating means such that a defrost operation can be performed in a time zone wherein a frequency of the opening/closing of the door is small. Therefore, it is possible to prevent the door being frequently opened or closed in a state where a storage room of the refrigerator cannot be refrigerated, and therefore, it is possible to prevent a temperature of the storage room from being abnormally increased.

There are a case where the numbers of opening/closing times of the respective time zones within only a day are stored in the opening/closing times memory and the indexes are set by the index setting means on the basis of the numbers of opening/closing times within the day, and a case where the numbers of opening/closing times of the respective time zones of a plurality of days are stored in the opening/closing times memory and the indexes are calculated by averaging the numbers of opening/closing times of the respective time zones of the plurality of days. In the former case, it is possible to make a capacity of the opening/closing times memory small, and therefore, the memory can be constructed simply.

If sudden phenomenon determining means is utilized, the indexes are renewed in only a case where it is determined that the numbers of opening/closing times of the respective time zones are not dependent on the sudden phenomenon. Therefore, by taking such a sudden phenomenon into consideration, the indexes having large reliabilities can be obtained, and therefore, it is possible to perform a defrost operation in a more or most suitable time zone.

If index selecting means is utilized, the indexes in a few time zones are selectively fetched by the index selecting means, and the defrost signal generating means generates the defrost on/off signal on the basis of the indexes of the few time zones. Accordingly, since it is possible for the defrost signal generating means to generate the defrost on/off signal on the basis of only the few indexes, the defrost signal generating means can be constructed simply.

Season determining means for generating season determination data on the basis of operating hours of a compressor with respect to total elapsed hours may be utilized and, in such a case, the defrost signal generating means generates the defrost on/off signal by taking the season determination data into consideration. Therefore, in accordance with the determination of a season, it is possible to perform a defrost operation at a more or most suitable timing.

By joining the plurality of indexes, a single index may be generated by index joining means. If such the index joining means is utilized, it is possible for the defrost signal generating means to generate the defrost on/off signal by taking a further large number of indexes into consideration. Therefore, a timing when a defrost operation is to be performed can be determined surely.

If feature detecting means for detecting features of the indexes is utilized, the defrost signal generating means generates the defrost on/off signal in accordance with feature amounts from the feature detecting means. In this case, since the defrost on/off signal is generated on the basis of a plurality of kinds of feature amounts, fine-adjustment of a defrost timing becomes simple.

If a neural network is utilized in the defrost signal generating means, the defrost on/off signal can be generated by the neural network. In such a case, data indicating whether of not a defrost operation is to be started is inputted in advance for desired data in the neural network as a teacher signal. Then, in accordance with a learning method such as back propagation, coupling coefficients and threshold values for cells of the neural network are determined, and it is adapted to make an error between the teacher signal and an outputted result becomes less than a predetermined value. By making the neural network learning in such a manner, when practical data are inputted into the network, the neutral network automatically performs an internal interpolation so as to generate the defrost on/off signal in a time zone where the number of opening/closing times of the door is small.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
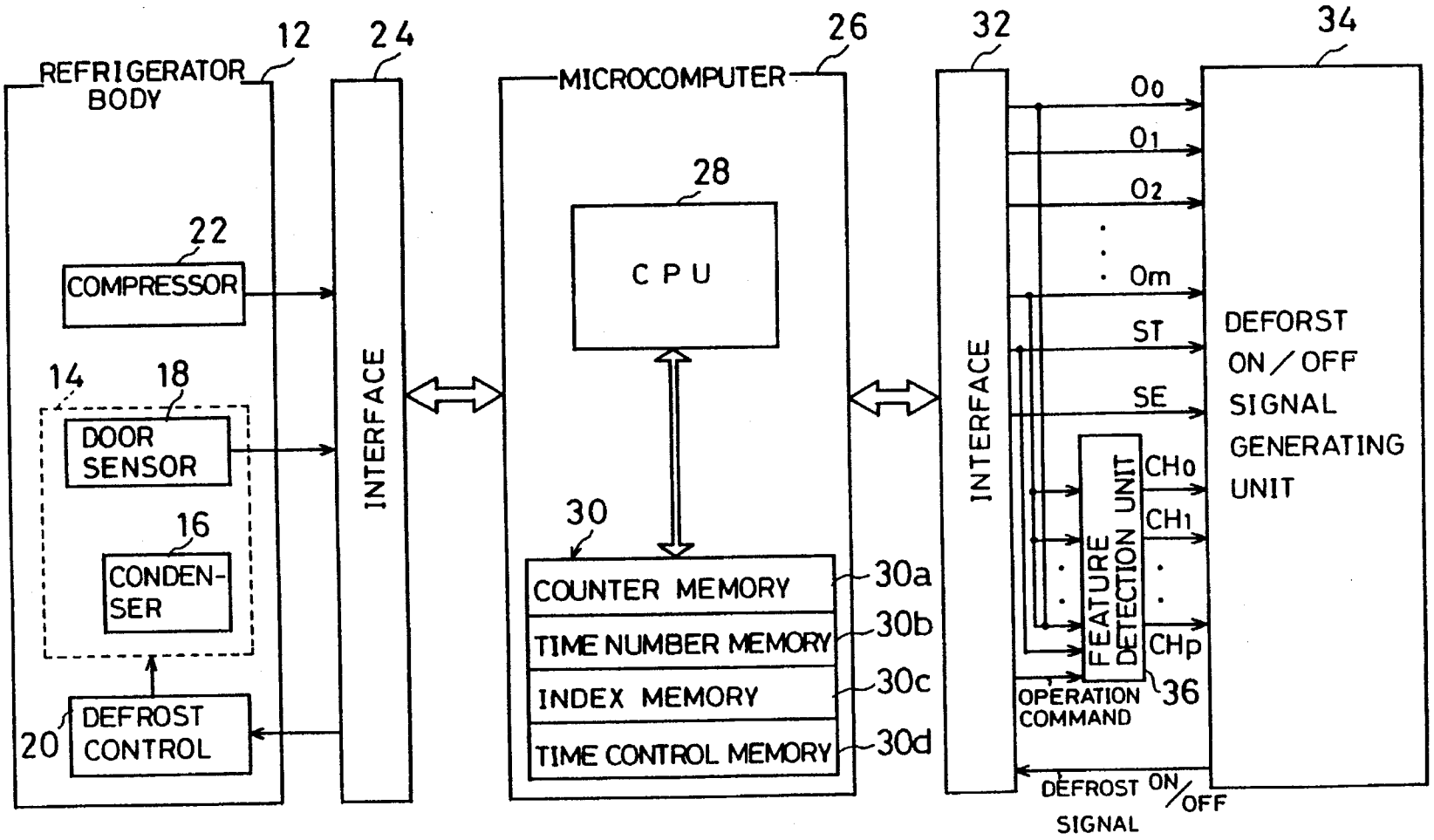
FIG. 1 is a block diagram showing a defrost control apparatus for refrigerator as one embodiment in accordance with the present invention.

With referring to FIG. 1, a defrost control apparatus for refrigerator 10 of this embodiment shown includes a refrigerator body 12. The refrigerator body 12 includes a storage room 14 which is cooled or refrigerated by a condenser 16. Opening or closing of a door (not shown) of the storage room 14 is detected by a door sensor 18. A defrost operation of the storage room 14 is controlled by defrost control circuit 20. In addition, the refrigerator body 12 is further provided with a compressor 22 which constitutes, together with the condenser 16, a part of a refrigeration cycle, and a refrigerant is supplied to the condenser 16 from the compressor 22.

A microcomputer 26 is connected to the refrigerator body 12 via an input/output interface 24. The microcomputer 26 includes a CPU 28 to which a memory 30 is coupled. The memory 30 includes a counter memory **30*a*, a time number memory 30*b*, an index memory 30*c* and a time control memory 30*d*. In the time control memory 30*d*, total elapsed hours TT, operating hours ST of the compressor 22, a current time T, and a current date D are stored. Furthermore, in the memory 30, a control program for controlling an operation of a microcomputer 26** is stored in advance.

Figure 2:
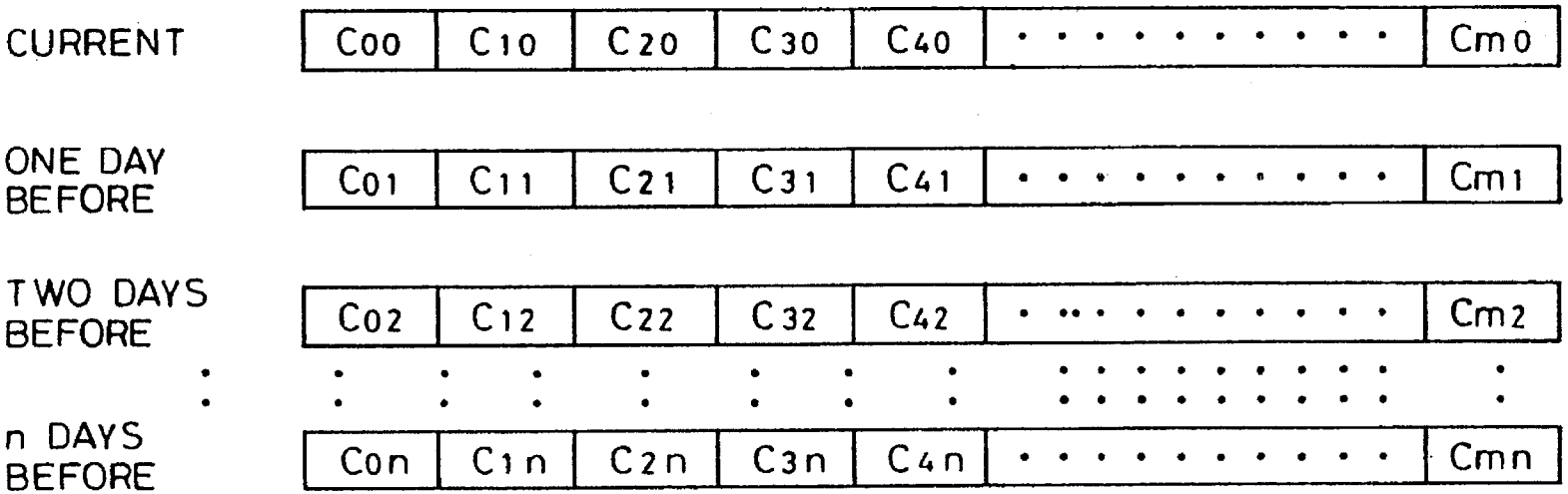
FIG. 2 is an illustrative view showing one structural example of an opening/closing times memory.

The CPU 28 counts the number of opening/closing times of the door in response to a signal from the door sensor 18, and stores the number of opening/closing times N in the counter memory **30*a*. Furthermore, the CPU 28 divides 24 hours of one day into a plurality of time zones each having a predetermined time TC, and the numbers of opening/closing times N for each of the time zones are stored in the time number memory 30*b* as the numbers of opening/closing times Cij. In this embodiment shown, one day is divided into 24 time zones, and therefore, the numbers of opening/closing times N for every one hour are stored in the time number memory 30*b* as the number of opening/closing times Cij. As shown in FIG. 2, the time number memory 30*b* is constructed as a matrix of $(m+1)\times(n+1)$, for example, wherein "m" indicates a magnitude of a time lapse direction, and therefore, $m=(24/TC)-1$, and "n" is indicative of the number of days during which the data are to be maintained in the time number memory 30*b***. Furthermore, "m" and "n" are determined so as to satisfy conditions $0\leqq i\leqq m$ and $0\leqq j\leqq n$ (each of i and j is integer). Therefore, if the predetermined time TC is set as one hour as described above, "m" becomes "23" (m=23).

Furthermore, in the index memory **30*c***, indexes Hi which can be obtained by substituting the number of opening/closing times Cij and etc. in the following equations (1) and (2).

Methods for representing the index Hi are different from each other in dependent on whether a timing of the defrost operation is to be determined by utilizing the numbers of opening/closing times Cij for only one day or the same is to be determined by utilizing the numbers of opening/closing times Cij for past n days. The index Hi is representative of an evaluation of the opening/closing of the door during respective time zones.

Specifically, in the former case, the index Hi can be represented by the equation (1). Furthermore, in the latter case, the index Hi can be represented by the equation (2), which is a mean value of the numbers of opening/closing times for each time zone i within past n days.

$$Hi=(14Hi+Ci0)/15 \tag{1}$$

$$Hi=\sum_{j=0}^{n} Cij/(n+1) \tag{2}$$

In addition, data of the total elapsed hours TT stored in the time control memory **30*d* indicates total elapsed hours from a time point that the above described counting operation is started or a time point that a previous defrost operation of the condenser 26 is terminated to a current time. Data of the operating hours ST of the compressor 22 stored in the time control memory 30*d* indicates integrated operating hours from a time point that the counting operation is started or a time point that a previous defrost operation of the condenser 16 is terminated to a current time. By the operating hours ST, refrigeration operating hours of the condenser 16** can be integrated indirectly.

The index outputs Oi (O0–Om), the operating hours ST and the season determination data SE are applied from the microcomputer 26 to the defrost signal generating unit 34 via the input/output interface 32.

At this time, the microcomputer 26 fetches only one or more indexes Hi of the time zones which are used for processes in the defrost signal generating unit 34 and the feature detecting unit 36 out of the indexes Hi, and the fetched index are set at the index outputs Oi to output the same to the input/output interface 32.

In addition, the season determination data SE is data for adjusting a starting time of a defrost operation. More specifically, the season determination data SE is obtained by detecting a ratio of the operating hours ST of the compressor 22 with respect to the total elapsed hours TT, and a season can be determined on the basis of a detected result. For example, if the ratio of the operating hours ST with respect to the total elapsed hours TT is large, it is determined that a season is summer, and if the ratio is small, it is determined that a season is winter.

Figure 3:
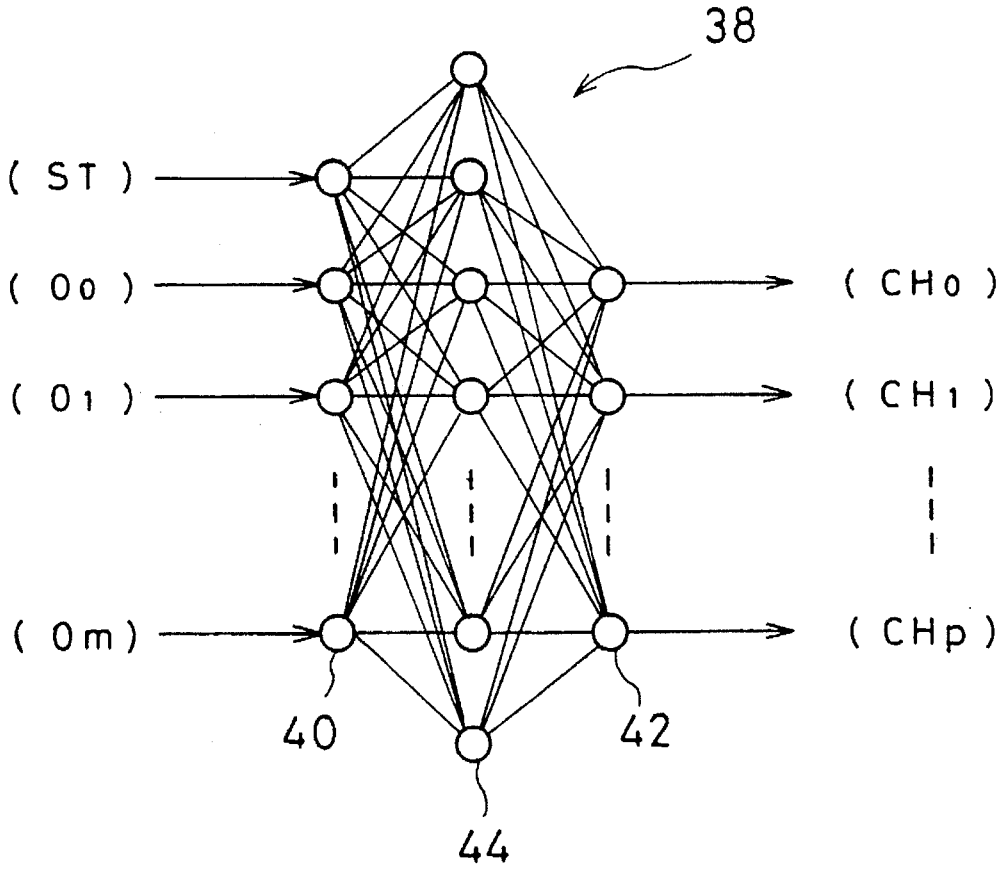
FIG. 3 is an illustrative view showing one structural example of a neural network which can be used for a feature detecting unit.

Furthermore, the index outputs Oi (O0–Om) and the operating hours ST both outputted from the microcomputer 26 are also applied to the feature detecting unit 36 via the input/output interface 32. The feature detecting unit 36 is started or enabled in response to an operation command from the microcomputer 26. The feature detecting unit 36 is constructed by a multi-layered neural network 38 as shown in FIG. 3. The neural network 38 includes an input layer 40, an output layer 42 and an intermediate layer 44. The input layer 40 includes cells of m+2 and receives the operating hours ST and the index outputs Oi, and feature amounts CHi (CH0–CHp) are outputted from the output layer 42. The number of cells of the output layer 42 is corresponding to the number of kinds of the feature amounts CHi as detected, that is, p+1. Each of the feature amounts CHi outputted from each of the cells of the output layer 42 indicates a degree of notability of the feature so as to be detected by a range of 0–1. In addition, the number of cells of the intermediate layer 44 is decided as necessary and enough number.

Figure 4:
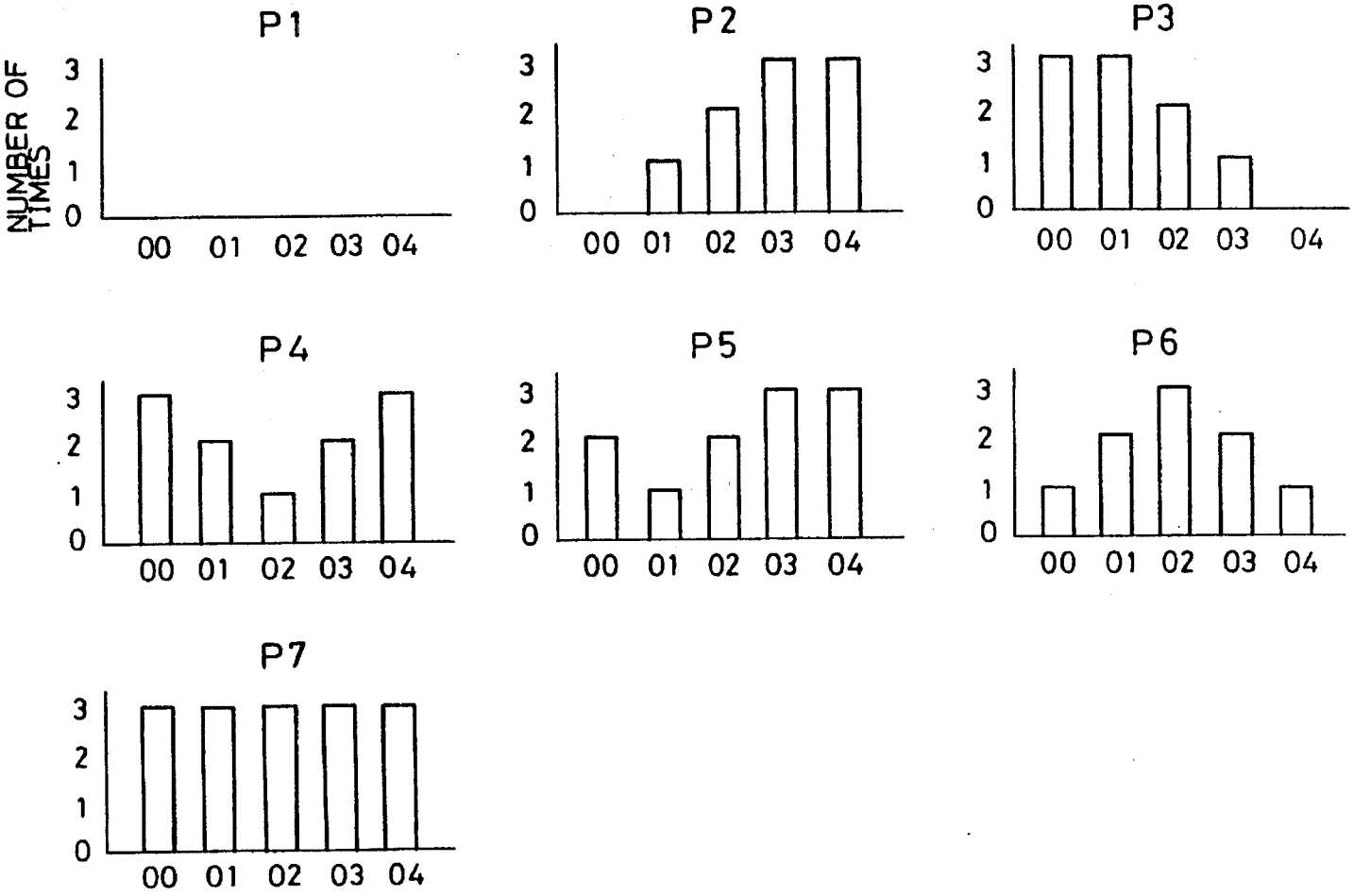
FIG. 4 is a graph showing a variation pattern which is stored in the neural network shown in FIG. 3.

As shown in FIG. 4, the feature detecting unit 36 has a storing function for storing modified patterns P of the index outputs Oi of 7 kinds, for example, and a detecting function for detecting a feature of each of the index output Oi by comparing the modified pattern and the new index output Oi. Each of the modified pattern is obtained by typing the variation manners of 5 data including the index output O0 of the current time zone, the index outputs O1 of the succeeding time zone, and the index outputs O2, O3 and O4 of the further succeeding time zones. The modified pattern P1 is a type where all the index outputs O0–O4 are zero, the modified pattern P2 is a type where the index output Oi becomes larger sequentially, the modified pattern P3 is a type where the index output Oi becomes smaller sequentially, the modified pattern P4 is a type where the variation manner of the index output Oi shows a form of valley at a middle part thereof, the modified pattern P5 is a type where a variation manner of the index output Oi shows a form of valley at an earlier part thereof, the modified pattern P6 is a type where a variation manner of the index output Oi shows a form of mountain, and the modified pattern P7 is a type where the index output Oi is constant at a relatively large level.

In the neural network 38, new index outputs Oi inputted to the input layer 40 and the modified pattern P1 are compared with each other, and the neural network 38 outputs a degree of similarity of the variation manner of the new index output Oi with respect to the modified pattern P1 as the feature amount CH0 of an output level of the range of 0–1. At this time, if the new index output Oi and the modified pattern P1 are opposite to each other, the output level becomes 0, and the output level is increased within the range of 0–1 as the both become similar to each other, and the output level becomes 1 when the both are the same. Likewise, in the neural network 38, a variation manner of the new index output Oi is compared with each of the respective modified patterns P2 to P7 sequentially. Then, the feature amount CH1 indicative of a degree of similarity of the new index output Oi with respect to the modified pattern P2 in a form of an output level 0–1, and each of the feature amounts CH2 to CH6 is outputted in corresponding to each of the modified patterns P3 to P7. The feature amounts CH0–CH6 are applied to the defrost signal generating unit 34.

The neural network 38 is learned in the following manner.

First, a few or several desired timings of the operating hours ST, index output Oi and feature amount CHi are decided in advance, and the same are utilized as teacher signals. Then, in accordance with a learning method such as the back propagation and etc., coupling coefficients and threshold values of the cells constituting the neural network 38 are determined such that an error between the teacher signal and an output result becomes less than a predetermined value.

By making the neural network 38 learning, the neural network 38 becomes to store the modified patterns P1–P7 of the index outputs Oi and to have a classifying or typing function with standards of the modifying patterns P1–P7. Therefore, when an input signal other than the teacher signals, that is, an input signal at a time when the refrigerator body 12 is practically operated is applied to the neural network 38, the neural network 38 automatically performs an internal interpolation so as to generate proper feature amounts CHi.

Figure 5:
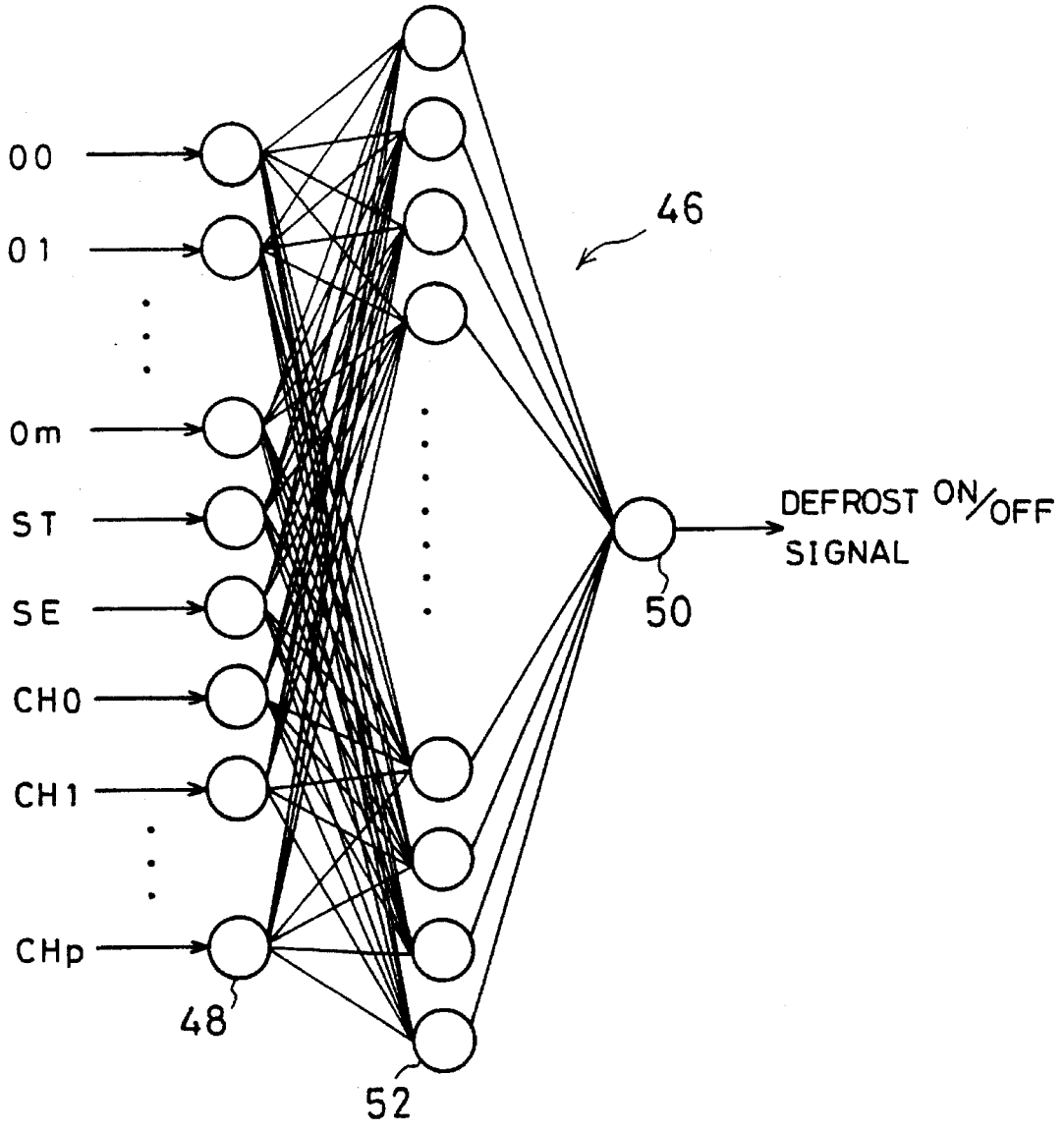
FIG. 5 is an illustrative view showing one structural example of a neural network included in a defrost signal generating unit.

The defrost signal generating unit 38 includes, as a major portion thereof, a neural network 46, for example, as shown in FIG. 5. The neural network 46 includes an input layer 48, an output layer 50 and an intermediate layer 52. Since the input layer 48 receives the index outputs Oi (O0–Om), the operating hours ST, the season determination data SE and the feature amounts CHi (CH0– CHp), the number of cells of the input layer 48 is (m+p+4). A defrost on/off signal which determines a defrost operation timing is outputted from the output layer 50, and the number of cells of the output layer 50 is 1. The number of cells of the intermediate layer 52 is set as necessary and enough number. A tendency that the defrost on/off signal commands to start the defrost operation becomes stronger as the operating hours ST becomes larger.

In addition, in this embodiment shown, such various processes for controlling the defrost operation are implemented as necessary, it is not necessary to input the data to all the cells of the input layer 48.

In addition, the neural network 46 is learned in the following manner.

In a case where the defrost on/off signal is to be generated on the basis of the operating hours ST and the index outputs Oi, data indicating whether or not a defrost operation is to be started are inputted to the neural network 46 in advance as the teacher signal in connection with combination of desired operating hours ST and the index outputs Oi. Then, in accordance with learning method such as the back propagation and etc., the coupling coefficients, threshold values and etc. of the cells constituting the neural network 46 are determined, so that an error of the teacher signal and the output result becomes less than a predetermined value.

In a case where the defrost on/off signal is to be generated on the basis of the operating hours ST and the index outputs Oi obtained by fetching the numbers of opening/closing times Hi of a few time zones out of a plurality of time zones of one day, data indicating whether or not a defrost operation is to be started are inputted to the neural network 46 in advance as the teacher signal in connection with combination of desired operating hours ST and index outputs Oi. Then, in accordance with a manner similar to the above described manner, the neural network 46 is made learning so as to determine the coupling coefficients, threshold values and etc., so that an error of the teacher signal and the output result becomes less than a predetermined value.

Furthermore, if a defrost on/off signal is to be obtained by further taking the season determination data SE into consideration, in connection with combination of desired operating hours ST, index outputs Oi and season determination data SE, data indicating whether a defrost operation is to be started are inputted to the neural network 46 in advance as the teacher signal.

In addition, in a case where a defrost on/off signal is to be generated on the basis of the feature amounts CHi, in connection with combination of desired feature amounts CH0–CHp, data indicating whether or not a defrost operation is to be started is inputted to the neural network 46 as the teacher signal.

Then, in the above described manner, the neural network is made learning to determine the coupling coefficients, threshold values and etc., so that an error between the teacher signal and an output result becomes less than a predetermined value.

By making the neural network 46 learning in the above described manner, the neural network 46 becomes to operate such that when an input signal other than the teacher signal, that is, an input signal at a time when the refrigerator body 12 is practically operated is outputted to the neural network 46, the neural network 46 automatically performs an internal interpolation so as to generate a defrost on/off signal in a time zone where the number of opening/closing times of the door is small.

On the basis of the defrost on/off signal, a refrigerant switching valve (not shown) in the refrigeration cycle is switched such that a high-temperature refrigerant is supplied to the condenser 16, or an electric heater is heated, and therefore, the condenser 16 can be defrosted. Since the defrost on/off signal is generated in a time zone where the number of opening/closing times of the door is small, it is possible to prevent the door from being frequently opened or closed in a state where the storage room 14 cannot be refrigerated, and therefore, it is possible to prevent a temperature of the storage room 14 from being increased abnormally.

Figure 6A:
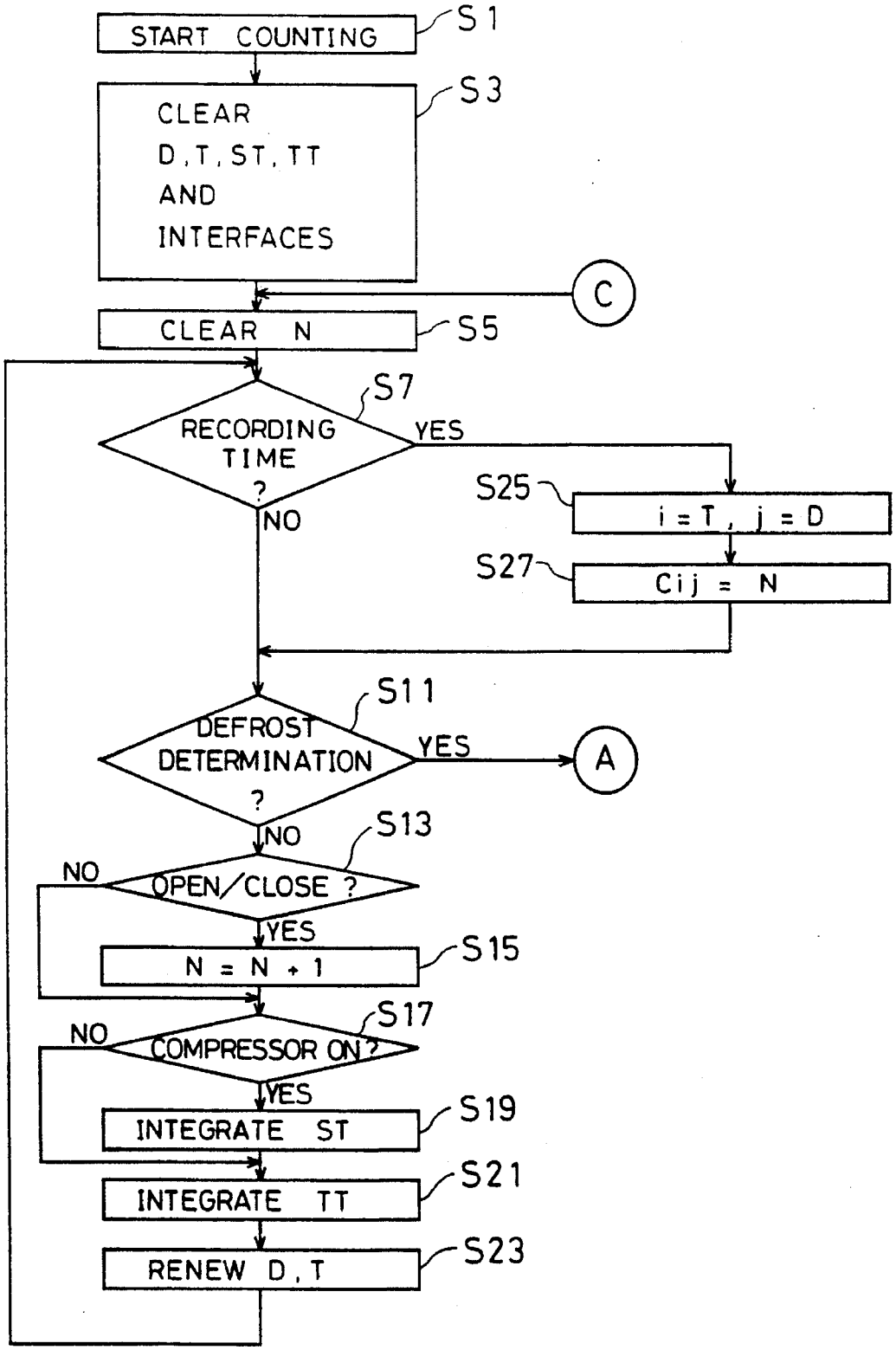
FIGS. 6A–6C are flowcharts showing an operation of the embodiment.
Figure 6B:
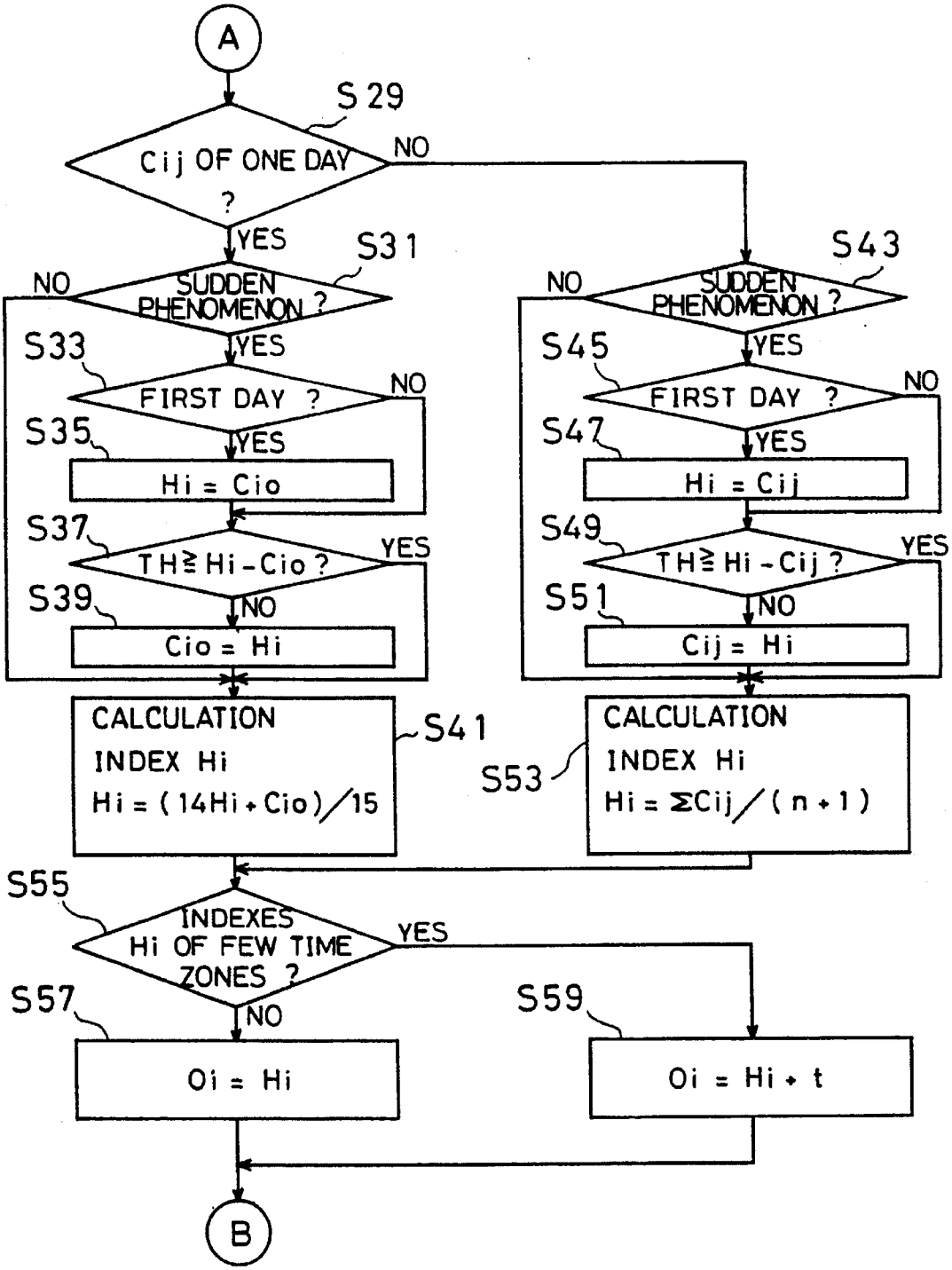
Figure 6C:
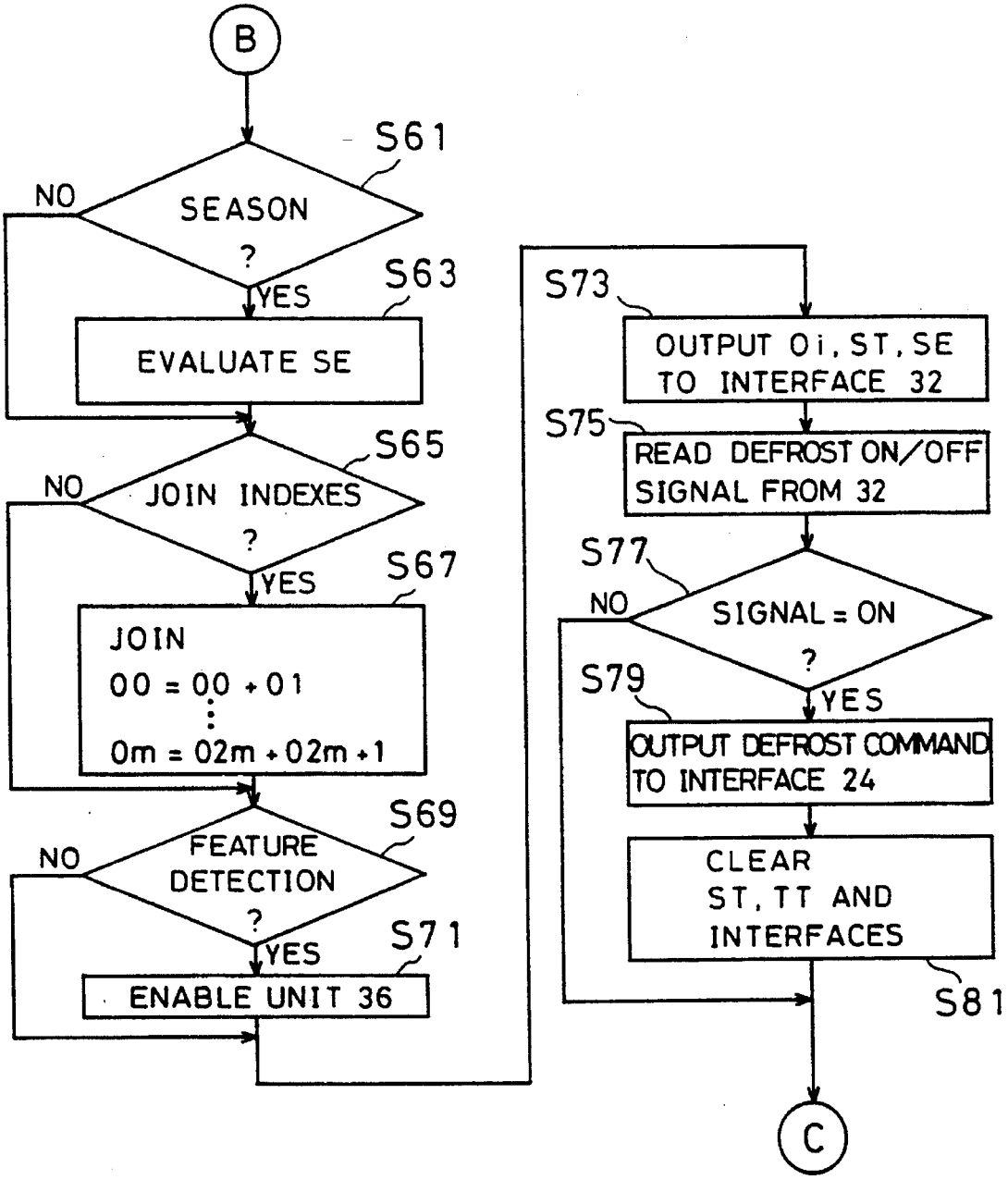

With referring to FIG. 6, an operation of this embodiment shown will be described. At first, after turning a power source on, various kinds of counting operations are started in a step S1.

Then, in a step S3, a current date D, a current time T, operating hours ST, total elapsed hours TT, and the input/output interfaces 24 and 32 are respectively cleared. In a step S5, a times number n is also cleared. Then, in a step S7, it is determined whether or not a current time becomes a recording time when the time number N is to be stored as the number of opening/closing times Cij. The recording time is determined at every one hour, for example.

If the current time does not reach the recording time in the step S7, in a step S9, it is determined whether or not the operating hours ST reaches a predetermined time, for example, 6 (six) hours shorter than 8 (eight) hours that is a normal integrated time until the defrost operation is started. If the operating hours reach the predetermined time in the step S9, in a step S11, it is determined whether or not a current time becomes a defrost determination time. The defrost determination time is determined at every 10 (ten) minutes shorter than one hour, for example. If the current time does not become the defrost determination time in the step S11, in a step S13, an opening/closing operation of the door is detected by the door sensor 18. If the operating hours ST do not reach the predetermined time in the step S9, the process proceeds to the step S13.

If the opening/closing operation of the door is detected in the step S13, the time number N indicative of the number of opening/closing times of the door is incremented in a step S15, and thereafter, the process proceeds to a step S17. The number of opening/closing times N is stored in the counter memory 30*a*. On the other hand, if the opening/closing operation of the door is not detected in the step S13, no increment is performed in time number N, and the process proceeds to the step S17.

In the step S17, it is determined whether or not the compressor 22 is turned-on, and, if the compressor 22 is turned-on, in a step S19, the operating hours ST of the compressor 22 is integrated, and then, the process proceeds to a step S21. On the other hand, if the compressor 22 is not turned-on in the step S17, the process proceeds to the step S21.

In the step S21, the total elapsed hours TT is integrated, and then in a step S23, the current date D and the current time T are renewed as necessary. Then, the process returns to the step S7. Therefore, the above described processes are repeated until the current time reaches the recording time in the step S7 and the current time reaches the defrost determination time in the step S11.

When the current time reaches the recording time in the step S7, in a step S25, the current time T and the current date D are respectively substituted for i and j (i=T and j=D). Thereafter, in a step S27, the number of opening/closing times N at a specific time zone i of a specific day j is stored in the time number memory 30*b* as the number of opening/closing times Cij (Cij=N). Then, the process proceeds to the step S9.

When the current time reaches the defrost determination time in the step S11, in a step S29, it is determined whether or not the number of opening/closing times Cij within one day is to be used for calculation and renewal of the index Hi. When the number of opening/closing times Cij within one day is to be used, the process proceeds to a step S31. In the step S31, it is further determined whether or not a sudden phenomenon is to be taken into consideration. When such a sudden phenomenon is to be taken into consideration, in a step S33, it is determined whether or not the current date D is a day that the defrost control apparatus is started to be operated at first, that is, current date D is the first day. In a case of the first day, in a step S35, the number of opening/closing times Ci0 of the day is substituted for the index Hi (Hi=Ci0), and thereafter, the process proceeds to a step S37. If the first day is not determined in the step S33, the process proceeds to the step S37. Therefore, in the step S37,it is determined whether or not a difference between the number of opening/closing times Ci0 at a specific time zone of the day where the data is to be renewed, and whether or not the index Hi is less than a threshold value TH.

When the difference between the index Hi and the number of opening/closing times Ci0 is larger than the threshold value TH in the step S37, in a step S39, the index Hi is substituted for the number of opening/closing times Ci0 (Ci0=Hi). That is, it is determined that the number of opening/closing times Ci0 at this time is dependent on the sudden phenomenon, and therefore, the same is not taken into consideration for calculation of the index Hi. Therefore, the process proceeds to a step S41, but the index Hi is not renewed so as to maintain the value of the previous day. On the other hand, if the difference between the index Hi and the number of opening/closing times Ci0 is less than the threshold value TH in the step S37, in a step S41, the index Hi is renewed on the basis of the number of opening/closing times Ci0.

In addition, in the step S41, the index is calculated in accordance with the above described equation (1), and a renewed index Hi is stored in the index memory 30c.

If a sudden phenomenon is not to be taken into consideration in the step S31, the process directly proceeds to the step S41 so that the index Hi is calculated and renewed while the number of opening/closing times Ci0 is always taken into consideration for such calculation.

On the other hand, the number of opening/closing times Cij of n days are used for calculation and renewal of the index Hi rather than the number of opening/closing times Cij of one day in the step S29, in a step S43, it is determined whether or not a sudden phenomenon is to be taken into consideration. When such a sudden phenomenon is to be taken into consideration, in a step S45, it is determined whether or not the current date D is a day that the defrost control apparatus is started to be operated at first, that is, the current date D is the first day. In a case of the first day, in a step S47, the number of opening/closing times Cij of the day is substituted for the index Hi (Hi=Cij), and thereafter, the process proceeds to a step S49. If the first day is not determined in the step S45, the process proceeds to the step S49. Therefore, in the step S49, it is determined whether or not a difference between the number of opening/closing times Cij at a specific time zone of the day where the data is to be renewed, and whether or not the index Hi is less than the threshold value TH.

When the difference between the index Hi and the number of opening/closing times Cij is larger than the threshold value TH in the step S49, in a step S51, the index Hi is substituted for the number of opening/closing times Cij (Cij=Hi). That is, it is determined that the number of opening/closing times Ci0 at this time is dependent on a sudden phenomenon, and therefore, the same is not taken into consideration for calculation of the index Hi. Therefore, the process proceeds to a step S53, but the index Hi is not renewed so as to maintain the value of the previous day. On the other hand, if the difference between the index Hi and the number of opening/closing times Ci0 is less than the threshold value TH in the step S49, in a step S53, the index Hi is renewed on the basis of the number of opening/closing times Cij.

In addition, in the step S53, the index is calculated in accordance with the above described equation (2), and a renewed index Hi is stored in the index memory 30c.

If a sudden phenomenon is not taken into consideration in the step S43, the process directly proceeds to the step S53 so that the index Hi is calculated and renewed while the number of opening/closing times Cij is always into consideration for such calculation.

After the steps S41 and S53 are executed, the process proceeds to a step S55. In the step S55, it is determined whether or not the index Hi of only a few time zones out of the plurality of time zones obtained by dividing one day are to be used. When the indexes Hi of all the time zones are to be used, in a step S57, the indexes Hi of all the time zones are set into the index outputs Oi. On the other hand, only the indexes Hi of the few time zones are to be used, in a step S59, the indexes Hji are set into the index outputs Oi by shifting the same by the current time (O=Hi+t). In addition, "t" indicates a time zone corresponding to the current time. That is, only the indexes of the time zone corresponding to the current time zone and the few time zones prior to the current time zone are set into the index output.

Next, in a step S61, it is determined whether or not a season determination is to be executed. If the season determination is to be executed, in a step S63, the season determination process is executed. More specifically, a ratio of the operating hours ST of the compressor 22 with respect to the total elapsed hours TT from a time point of the previous defrost operation is detected, and on the basis of such a detection result, the season determination data SE by which a season can be determined is obtained. Thereafter, the process proceeds to a step S65. If it is not necessary to execute the season determination in the step S61, the process directly proceeds to the step S65.

In a step S65, it is determined whether or not a plurality of index outputs Oi are to be joined. If so, in a step S67, the index outputs Oi closing to each other are added to each other. For example, O0=O0+O1, . . . , Om=O2m+O2m+1. Thereafter, the process proceeds to a step S69. The reason why the index outputs Oi closing to each other are added to each other is as follows:

In comparison with a summer season, an integrating speed of the operating hours ST of the compressor 22 becomes slow in a winter season, and therefore, there is a sufficient time until a scheduled time for starting the defrost operation, that is, until a time point at that the operating hours ST becomes 6 (six) hours, for example, is reached. Therefore, within the sufficient time, it is possible to take the index outputs Oi of the time zone considerably before the current time into consideration for determining a time point at which the defrost operation is started, a time point at which the defrost operation can be set more surely in the winter season. On the other hand, if the number of data to be inputted to the defrost operation starting unit 34 is increased, it is necessary to increase the number of cells of the input layer 48 of the neural network 46, and therefore, the structure of the neural network 46 becomes complex. Therefore, in this embodiment shown, in the winter season, the index outputs Oi of the plurality n (n is 2 or 3, for example, in this embodiment shown) of time zones adjacent to each other are added to each other so that a single index output is inputted to the neural network 46.

On the other hand, if the plurality of index outputs Oi are not to be joined to output a single index output in the step S65, the process proceeds to a step S69. In the step S69, it is determined whether or not a feature detection is to be executed. In a case where the feature detection is to be executed, in a step S71, the feature detecting unit 36 is started or enabled in response to an operation command from the microcomputer 26, and thereafter, the process proceeds to a step S73. If not feature detection is to be executed in the step S69, the process directly proceeds to the step S73. In the step S73, the index output Ci, the operating hours ST and the season determination data SE are outputted to the input/output interface 32 from the microcomputer 26. On the basis of the data, the defrost signal generating unit 34 and the feature detecting unit 36 are operated in the following manner.

In a case where the defrost on/off signal is to be generated in the neural network 46 constituting the defrost signal generating unit 34 on the basis of the index outputs Oi to which the indexes Hi of all the time zones of one day are set and the operating hours ST, the operating hours ST and the index outputs Oi are inputted to the input layer 48 of the neural network 46. The, in the neural network 46, it is determined whether or not it is desired that a defrost operation is to be executed at that time point, so that the defrost operation can be performed at a time zone where the frequency of the opening/closing the door is small. Therefore, it is possible to prevent a temperature of the storage room 14 from being abnormally increased due to a defrost operation in a state where the storage room 14 cannot be refrigerated or cooled.

Furthermore, in a case where the defrost on/off signal is to be generated on the basis of the index outputs Oi to which the indexes Hi of the few time zones are set and the operating hours ST, for example, only the indexes Ht, Ht+1 and Ht+2 of the time zone t corresponding to the current time, and the time zone t+1 and t+2 prior to the time zone t are selected, the indexes Ht, Ht+1 and Ht+2 are set into the index outputs O0, O1 and O2. Therefore, the operating hours ST and the index outputs O0, O1 and O2 are inputted to the input layer 48 of the neural network 46. Therefore, in this case, the number of cells of the input layer 48 may be 4 (four). Then, in the neural network 46, it is determined whether or not it is desired that a defrost operation is performed at that time point.

More specifically, in the neural network 46, after the operating hours ST of the compressor 22 elapsed by a predetermined time, at a time point for the defrost determination, on the basis of the index outputs O0, O1 and O2, the frequency of the opening/closing of the door is increased or decreased. When the frequency of the opening/closing of the door is increased, the neural network 46 immediately outputs the defrost on/off signal for starting a defrost operation at that time point. If the frequency of the opening/closing of the door is decreased, a time for starting the defrost operation is extended from that time point such that the defrost on/off signal for starting a defrost operation is outputted from the neural network 46 after a predetermined time, 5–6 hours, for example, elapsed.

Therefore, a defrost operation is performed within a time zone where the frequency of opening/closing of the door is small, and therefore, it is possible to prevent a temperature of the storage room 14 from being abnormally increased. Furthermore, only the indexes Hi of the few time zones may be inputted to the defrost signal generating unit 34, and therefore, it is possible to decrease an amount of the data to be inputted to the defrost signal generating unit 34 so that the process becomes simple.

Furthermore, in a case where the defrost on/off signal is generated while the season determination data SE is further taken into consideration, the index outputs Oi, the operating hours ST and the season determination data SE are inputted to the input layer 48 of the renewal neural network 46.

Then, in the neural network 46, it is determined whether or not it is desired that a defrost operation is performed at that time point. More specifically, in the neural network 46, after the operating hours ST of the compressor 22 elapsed by a predetermined time, at a time point for the defrost determination, the index outputs Oi are compared with each other. For example, if the index outputs O0 and the outputs O1 and O2 prior to the output O0 are utilized, the index output O0 is compared with the index outputs O1 and O2, respectively. On the basis of the index outputs O0, O1 and O2, it is determined whether the frequency of the opening/closing of the door is increased or decreased. When the frequency of the opening/closing of the door is increased, the neural network 46 immediately outputs the defrost on/off signal for starting a defrost operation at that point. If the frequency of the opening/closing of the door is decreased, a time for starting a defrost operation is extended from that time point such that the defrost on/off signal for starting a defrost operation is outputted from the neural network 46 after a predetermined time, 5–6 hours, for example, elapsed. Furthermore, in this case, the neural network 46 finely adjusting a time point when the defrost on/off signal for starting a defrost operation is to be generated in accordance with the season determination data SE.

Furthermore, in a case where the defrost on/off signal is to be generated by using the index outputs Oi to which the indexes Hi of the few time zones are set and the season determination data SE, the index outputs O0, O1 and O2, the operating hours ST and the season determination data SE are inputted to the neural network 46. Therefore, a time point when the defrost on/off signal is to be generated is finely adjusted by taking not only the index outputs O0, O1 and O2 but also the season determination data SE into consideration. In such a case, the number of cells of the input layer 48 may be 5 (five). The season determination data SE is data indicating how much the time point when the defrost on/off signal is to be generated closes to the summer, and therefore, by supplying such the season determination data SE to the neural network 46, a time point when the defrost operation is to be started is finely adjusted, so that the time point for starting the defrost operation becomes to be earlier in the summer season and the the time point for starting the defrost operation becomes to be later in the winter season. According to this embodiment show, in a case where an operating ratio of the compressor 22 is large, the summer season is determined, and therefore, a time for starting a next defrost operation is shortened and, in a case where the operating hours ratio of the compressor 22 is small, the winter season is determined, and therefore, a time until a next defrost operation extended. Therefore, it is possible to perform a defrost operation at a more or most suitable timing according to the season.

Furthermore, if the defrost on/off signal is to be generated by determining a season and by joining a plurality of index outputs Oi, the process is executed as follows:

As one example, a description of a case where the indexes of the few time zones are to be used in the step S55 and a season is to be determined in the step S61 and the plurality of index outputs Oi are to be joined as a single index in the step S65 will be described.

When the defrost determination time is reached after a predetermined time is elapsed on the operating hours ST, the season determination data SE, and the index outputs are inputted to the neural network 46. More specifically, in the summer season, the indexes at time zones t, t+1 and t+2, that is, index outputs C0, O1 and O2 are outputted to the neural network. On the other hand, in the winter season, data obtained by adding or joining the index outputs O0 and O1 at time zones t and t+1, data obtained by adding or joining index outputs O2 and O3 at time zones t+2 and t+3, and data obtained by adding or joining the index outputs O4 and O5 at time zones t+4 and t+5 are inputted to the neural network 46. Thus, in the winter season, since each of the index outputs is obtained by adding the two index outputs Oi to each other, in the neural network 46, it is possible to take into consideration for generating the defrost on/off signal not only the index outputs O0, O1 and O2 but also outputs O3, O4 and O5. Therefore, in this embodiment shown, it is possible to perform a defrost operation at a most suitable timing in accordance with a season without increase the number of cells of the neural network 46.

In addition, the number of index outputs Oi to be taken into consideration for generating the defrost on/off signal in the winter season is not limited to double of the number of index outputs in the summer season, and therefore, the number of index outputs in the winter season may be arbitrary integer times the number of index outputs in the summer season. Furthermore, in the winter season, only initial two index outputs O0 and O1 are added or joining to each other to generate a single index output O0, and each of the remaining index output may be inputted as a single index.

Furthermore, it can be considered that two neural networks may be provided in a control apparatus and by changing the same in accordance with the number of index outputs Oi in the summer season or the winter season; however, in the above described embodiment, only a single neural network is used irrespective of the summer season or the winter season, and therefore, the above described embodiment becomes simple in comparison with the control apparatus having two neural networks.

Next, in a case where the defrost on/off signal is generated by feature detecting, the feature detecting unit 36 is started or enabled by an operation command from the microcomputer 26, and outputs the feature amounts CH0–CHn in accordance with the values of the operating hours ST and the index outputs Oi.

More specifically, when the defrost determination time after the operating hours ST of the compressor 22 reaches the predetermined time, the neural network 38 constituting the feature detecting unit 36 compares the respective index outputs Oi and the respective modified patterns P1–P7 with each other. Then, the neural network 38 inputs respective feature amounts CH0–CH6 obtained by weighing the respective modified patterns P1– P7 according to the similarity of the index outputs Oi with the output level of the range of 0–1 to the defrost signal generating unit 34. The neural network 46 constituting the defrost signal generating unit 34 determines whether or not it is desired that the defrost operation is to be performed at that time point on the basis of the feature amounts CH0–CH6 and the operating hours ST so as to output the defrost on/off signal. For example, in a state where the level of the feature amount CH6 is positive large, a status of the index output Oi is the modified pattern P1, and therefore, a defrost operation is started on the inference that the door is not opened and closed from the present time point to a time point after 5 (five) hours. For example, in a case where the level of the feature amount CH2 is large, a status of the index output Oi is the modified pattern P3, and therefore, a defrost operation is performed after 5 of 6 hours from the present time point on the inference that the door will become not to be opened or closed after few or several hours from the present time point. Thus, in the feature detecting unit 36, by storing the modified patterns P1–P7 of the index outputs Oi and by comparing the modified patterns P1–P7 with new index outputs Oi, the feature of the index outputs Oi is detected. Since if the defrost on/off signal is thus outputted on the basis of the feature amounts CH0–CH6, it is possible to make a fine adjustment of a defrost timing simple.

The feature amounts CH0–CH6 are obtained in accordance with the number of peaks of the number of opening/closing times Cij of one day, an interval between the peaks, a difference between the frequencies of the number of opening/closing times of the door in the summer season or the winter season, and etc. In addition, if the season determination data SE as well as the feature amounts CHi are inputted to the neural network 46, it is possible to finely adjust a time point for starting a defrost operating by taking the season into consideration.

In addition, in a case where the feature detecting is performed, a fuzzy inference circuit may be utilized in the defrost signal generating unit 34. In such a case, the defrost on/off signal can be generated by executing a fuzzy inference of a type of IF - - - THEN in the fuzzy inference circuit.

If a fuzzy inference of the type of IF - - - THEN can be performed in the defrost signal generating unit 34, it becomes easy for a circuit designer of a control apparatus to rectify his design concept to the circuit structure, and the learning to the neural network 38 can be performed simply.

In addition, the indexes Hi utilized in the above described embodiments are renewed by performing arithmetic calculations according to the equation (1) or (2), it is possible to set a timing when a defrost operation is to be started surely in accordance with the last value of the frequency of the opening/closing of the door. In addition, in a case where it is determined that the number of opening/closing times Cij of only one day is to be used in the step S29, it is not necessary to provide a memory capacity capable of storing the number of opening/closing times for a plurality days. Therefore, the memory structure becomes simple.

Furthermore, in a case where the sudden phenomenon is to be taken into consideration for generating the defrost on/off signal, the difference between the number of opening/closing times Cij and the index Hi at each of the respective time zones is detected, and the index Hi is renewed only when the difference is less than the threshold value TH. Therefore, if the number of opening/closing times Cij is suddenly increased or decreased, the data of the number of opening/closing times Cij in such a case is ignored. Therefore, it is possible to obtain a reliable index without influence of the sudden phenomenon. Therefore, with simple structure, it is possible to prevent the temperature of the storage room from being increased at a defrost time.

Thus, the defrost on/off signal is generated from the defrost signal generating unit 34. Thereafter, in a step S75, the microcomputer 26 reads the defrost on/off signal from the input/output interface 32. Then, in a step S77, it is determined whether or not the defrost on/off signal indicates a defrost operation starting, that is, it is determined whether or not the defrost on/off signal is on. If the defrost on/off signal is on in the step S77, in a step S79, the microprocessor 26 outputs a defrost command to the defrost control circuit 20 via the input/output interface 24. In response to the defrost command, the refrigerant flow switching valve (not shown) of the refrigeration cycle is switched so as to supply a high-temperature refrigerant to the condenser 16 or an electric heater (not shown) is heated such that the condenser 16 can be defrosted. Then, in a step S81, the operating hours ST, the total elapsed hours TT and the interfaces 24 and 32 are respectively cleared, and thereafter, the process returns to the step S5. On the other hand, if the defrost on/off signal is not on in the step S77, the process directly returns to the step S5.

In addition, in the above described embodiment, the neural network 46 having a relatively complex structure is used for the defrost signal generating unit 34 so that a defrost operation control can be performed under various kinds of conditions. However, if the defrost on/off signal can be obtained on the basis of only the indexes Hi of the respective time zones, that is, index outputs Oi and the operating hours ST, it is possible to make the neural network 46 simple.

Furthermore, if the indexes Hi of only the few time zones are used for generating the defrost on/off signal, the neural network 46 can be more simple according to the decrease of the input data. In the above described embodiment, since the three indexes Hi are used, including the cell for the operating hours ST, 4 (four) is enough for the number of cells of the input layer 48.

In addition, if the defrost on/off signal is generated on the basis of the index Ht at a single time zone (t), the neural networks 38 and 46 become the most simple; however, if such a case, it is impossible to predict a status of opening and closing the door after the present time point, and therefore, in the above described embodiment, the number of indexes Hi is decided as 3 (three). However, the number of indexes may be increased or decreased.

Furthermore, a fuzzy inference circuit may be used in the defrost signal generating unit 34.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for controlling a defrost operation of a refrigerator having a defrost device, comprising:

counting means for counting a number of opening/closing times of a door for each of a plurality of time zones of one day;

time number memory means for storing the number of opening/closing times of the respective time zones, said time number memory means including a storage area for storing the number of opening/closing times of the respective time zones of one day;

index setting means for setting indexes of the respective time zones in accordance with the number of opening/closing times of the respective time zones, said index setting means setting said indexes in accordance with the number of opening/closing times of one day;

defrost signal generating means for generating a defrost on/off signal for controlling said defrost device on the basis of said indexes; and first determining means for determining whether or not a sudden phenomenon occurs on the basis of the number of opening/closing times and the indexes of the respective time zones;

wherein said index setting means includes renewing means for renewing the indexes only when it is determined that no sudden phenomenon occurs by said first determining means.

2. A defrost control apparatus in accordance with claim 1, further comprising selecting means for selectively fetching a part of indexes of said respective time zones, wherein said defrost signal generating means generates a defrost on/off signal on the basis of the indexes fetched by said selecting means.

3. A defrost control apparatus in accordance with claim 2, further comprising second determining means for generating season determination data on the basis of a ratio of operating hours of a compressor with respect to total elapsed hours, wherein said defrost signal generating means generates the defrost on/off signal on the basis of said indexes and said season determination data.

4. A defrost control apparatus in accordance with claim 3, further comprising joining means for joining the pluralities of indexes so as to generate an joined index, wherein said defrost signal generating means generates the defrost on/off signal on the basis of the joined index at least.

5. A control apparatus for controlling a defrost operation of a refrigerator having a defrost device, comprising:

counting means for counting a number of opening/closing times of a door for each of a plurality of time zones of one day;

time number memory means for storing the number of opening/closing times of the respective time zones;

index setting means for setting indexes of the respective time zones in accordance with the number of opening/closing times of the respective time zones;

defrost signal generating means for generating a defrost on/off signal for controlling said defrost device on the basis of said indexes; and second determining means for generating season determination data on the basis of a ratio of operating hours of a compressor with respect to total elapsed hours;

wherein said defrost signal generating means generates the defrost on/off signal on the basis of said indexes and said season determination data.

6. A defrost control apparatus in accordance with claim 5, further comprising joining means for joining the pluralities of indexes so as to generate an joined index, wherein said defrost signal generating means generates the defrost on/off signal on the basis of the joined index at least.

7. A control apparatus for controlling a defrost operation of a refrigerator having a defrost device, comprising:

counting means for counting a number of opening/closing times of a door for each of a plurality of time zones of one day;

time number memory means for storing the number of opening/closing times of the respective time zones;

index setting means for setting indexes of the respective time zones in accordance with the number of opening/closing times of the respective time zones;

defrost signal generating means for generating a defrost on/off signal for controlling said defrost device on the basis of said indexes; and feature detecting means for detecting a feature of the index, said feature detecting means including both storage for storing a plurality of modified patterns of the index and a detector for detecting a new index through comparison of the new index and the modified patterns;

wherein said defrost signal generating means generates the defrost on/off signal in accordance with a feature amount detected by said feature detecting means.

8. A defrost control apparatus in accordance with claim 7, wherein said feature detecting means includes a neural network for generating said feature amount on the basis of the index.

9. A control apparatus for controlling a defrost operation of a refrigerator having a defrost device, comprising:

first counting means for counting a number of opening/closing times of a door for each of a plurality of time zones of one day;

time number memory means for storing the number of opening/closing times of the respective time zones;

index setting means for setting indexes of the respective time zones in accordance with the number of opening/closing times of the respective time zones;

second counting means for counting operating hours of a compressor; and defrost signal generating means for generating a defrost on/off signal for controlling said defrost device on the basis of said indexes, said defrost signal generating means including a neural network in which data indicating whether or not a defrost operation is to be started are learned in advance on the basis of said operating hours of said compressor, said defrost signal generating means generating the defrost on/off signal according to a result of said neural network.

10. A defrost control apparatus in accordance with claim 9, further comprising joining means for joining the pluralities of indexes so as to generate a joined index, wherein said defrost signal generating means generates the defrost on/off signal on the basis of the joined index at least.

11. A control apparatus for controlling a defrost operation of a refrigerator having a defrost device, comprising:

counting means for counting a number of opening/closing times of a door for each of a plurality of time zones of one day;

time number memory means for storing the number of opening/closing times of the respective time zones;

index setting means for setting indexes of the respective time zones in accordance with the number of opening/closing times of the respective time zones;

defrost signal generating means for generating a defrost on/off signal for controlling said defrost device on the basis of said indexes; and first determining means for determining whether or not a sudden phenomenon occurs on the basis of the number of opening/closing times and the indexes of the respective time zones; wherein:

said time number memory means includes a storage area for storing the number of opening/closing times of the respective time zones of a plurality of days;

said index setting means evaluates the index by averaging the number of opening/closing times of each of the respective time zones of said plurality of days; and said index setting means includes renewing means for renewing the indexes only when it is determined that no sudden phenomenon occurs by said first determining means.

12. A defrost control apparatus in accordance with claim 11, further comprising selecting means for selectively fetching a part of indexes of said respective time zones, wherein said defrost signal generating means generates a defrost on/off signal on the basis of the indexes fetched by said selecting means.

13. A defrost control apparatus in accordance with claim 11, further comprising second determining means for generating season determination data on the basis of a ratio of operating hours of a compressor with respect to total elapsed hours, wherein said defrost signal generating means generates the defrost on/off signal on the basis of said indexes and said season determination data.

14. A defrost control apparatus in accordance with claim 12, further comprising second determining means for generating season determination data on the basis of a ratio of operating hours of a compressor with respect to total elapsed hours, wherein said defrost signal generating means generates the defrost on/off signal on the basis of said indexes and said season determination data.

15. A defrost control apparatus in accordance with claim 11, further comprising joining means for joining the pluralities of indexes so as to generate an joined index, wherein said defrost signal generating means generates the defrost on/off signal on the basis of the joined index at least.

16. A defrost control apparatus in accordance with claim 14, further comprising joining means for joining the pluralities of indexes so as to generate an joined index, wherein said defrost signal generating means generates the defrost on/off signal on the basis of the joined index at least.

17. A defrost control apparatus in accordance with claim 11, further comprising joining means for joining the pluralities of indexes so as to generate an joined index, wherein said defrost signal generating means generates the defrost on/off signal on the basis of the joined index at least.

18. A defrost control apparatus in accordance with claim 17, wherein said feature detecting means includes a neural network for generating said feature amount on the basis of the index.

* * * * *